US007909626B2

(12) United States Patent
Lust

(10) Patent No.: US 7,909,626 B2
(45) Date of Patent: Mar. 22, 2011

(54) TWO-PART CONNECTOR-COVER FOR TRAILER HITCH ELECTRICAL CONNECTORS

(75) Inventor: Patrick John Lust, Coquitlam (CA)

(73) Assignee: Rug Sense, LLC, Sleepy Hollow, NY (US)

( * ) Notice: Subject to any disclaimer, the term of this patent is extended or adjusted under 35 U.S.C. 154(b) by 0 days.

(21) Appl. No.: 12/467,143

(22) Filed: May 15, 2009

(65) Prior Publication Data

US 2010/0216324 A1 Aug. 26, 2010

Related U.S. Application Data

(60) Provisional application No. 61/153,597, filed on Feb. 18, 2009.

(51) Int. Cl.
*H01R 13/44* (2006.01)

(52) U.S. Cl. ..... 439/135

(58) Field of Classification Search ..... 439/134, 439/135, 148, 34, 35, 680
See application file for complete search history.

(56) References Cited

U.S. PATENT DOCUMENTS

| | | | | |
|---|---|---|---|---|
| 5,984,724 | A * | 11/1999 | McNeel | 439/606 |
| 6,273,729 | B1 * | 8/2001 | Kelly | 439/36 |
| 7,287,992 | B2 * | 10/2007 | Chawgo | 439/135 |
| 2007/0099456 | A1 * | 5/2007 | Chawgo | 439/135 |

* cited by examiner

*Primary Examiner* — Javaid Nasri

(57) ABSTRACT

The invention is a 2-piece electrical connector cover for protecting electrical connectors having a plug and a socket. A first piece has an internal diameter and an external diameter. The internal diameter is frictionally equivalent to the external diameter of the plug, so that the first piece fits snugly on the plug and protects it. The second piece of the electrical connector cover also has an internal and an external diameter. The external diameter of the second piece is frictionally equivalent to the internal diameter of the socket so that the second piece fits snugly into the socket and protects it. The external diameter of the first piece is frictionally equivalent to the external diameter of the second piece, so that the first piece fits snugly into the second piece, thereby holding the two pieces together when they are not being used to protect the electrical connector.

21 Claims, 3 Drawing Sheets

TWO-PART CONNECTOR-COVER FOR TRAILER HITCH ELECTRICAL CONNECTORS

CROSS-REFERENCE TO RELATED APPLICATIONS

This application claims priority to U.S. provisional patent application No. 61/153,597 filed Feb. 18, 2009, incorporated herein by reference in its entirety.

BACKGROUND

1. Field of the Invention

This invention relates to covers for electrical connectors, and more particularly to covers for electrical connectors used in trailer hitches and the like.

2. Existing Art

Trailer hitches are well known for both commercial and domestic vehicles. Such hitches allow a trailer to be reversibly attached to a towing vehicle such as a tractor-trailer, truck, or car. As used herein, "trailer hitch" is used broadly to include trailer and equipment hitches of any description, including recreational trailer hitches, boat trailer hitches, agricultural equipment hitches, commercial tractor-trailer hitches, and hitches employed for military purposes.

With respect to the use of trailers on public streets and roads, all jurisdictions require that trailers over a given length be fitted with tail lights, turn signals, and break lights. Commercial trailers generally have substantially greater lighting requirements, such as running lights. Consequently, trailer hitches are provided with accessory electrical connectors that allow electrical circuits to be formed between the electric source of the towing vehicle and the electrical components on the trailer. These electrical connectors generally comprise a socket and a plug. The socket has a recessed space within which a plurality of male electrical connectors protrude. The plug includes a plurality of female electrical connectors arranged in a pattern that is complementary to the male connectors of the socket. A tab often protrudes from the plug that engages a slot in the socket to ensure proper alignment of the male and female electrical connectors.

There have been many attempts to provide protective devices for such trailer hitch electrical sockets and plugs. This goal represents a significant challenge since these electrical connectors are exposed to harsh elements, particularly when the plugs and sockets are disengaged. One of the most common protective devices is for the socket to have a spring-loaded cover attached to the socket that is intended to prevent water, dust, and dirt from getting into the socket. Unfortunately, existing protective devices have several disadvantages that limit their effectiveness and ease of use.

BRIEF DESCRIPTION OF THE INVENTION

The invention may be briefly summarized as a cover for electrical connectors of the type having an electrical plug that mates with an electrical socket, the cover comprises a) a socket-plug, the socket-plug having an external diameter and an internal diameter, wherein the external diameter of the socket-plug is frictionally equivalent to the internal diameter of the electrical socket; and, b) a plug-cover, the plug-cover having an external diameter and an internal diameter, wherein the internal diameter of the plug-cover is frictionally equivalent to the external diameter of the electrical plug.

The internal diameter of the plug-cover may be frictionally equivalent to the external diameter of the socket-plug.

The socket-plug may comprise a grip-tab.

Either the socket-plug or the plug-cover or both may comprise a friction element. The friction element may be a ridge.

The socket-plug may comprise an alignment key, and the plug-cover may comprise an alignment protrusion or an indentation wherein the alignment protrusion or indentation accommodates the alignment key.

BRIEF DESCRIPTION OF THE DRAWINGS

In the drawings identical reference numbers are employed to identify identical or analogous elements. Identical elements of a plurality are generally given the same reference numeral. The sizes and relative positions of the elements in the drawings are not necessarily to scale.

DETAILED DESCRIPTION OF THE INVENTION

Structure

The present invention comprises a 2-part electrical connector-cover for protecting the socket and plug electrical connectors used in conjunction with trailer hitches. The examples disclosed here relate to electrical connectors that are primarily used in non-commercial trailers including boat trailers, utility trailers, horse trailers, agricultural equipment and the like. In such applications, the socket portion of the electrical connector is usually mounted on the towing vehicle and the plug portion is mounted on the trailer. The invention is equally applicable to commercial trailers such as those employed in over-the-road and long-haul commercial vehicles. In the later case, the socket housing the male connectors is normally mounted on the trailer and the plug housing female connectors is carried by the tractor. The diameters of the plugs and sockets are normally smaller in the commercial applications. However, all of these distinctions and variations are well within the scope of the present invention, which includes all socket-plug type electrical connectors for trailers and towed equipment.

Figure 1:
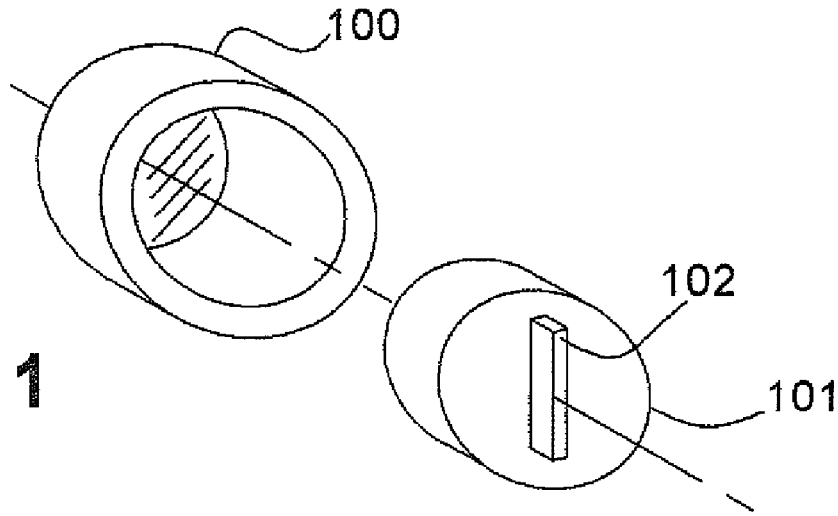
FIG. 1 is a first perspective view of the components of the invention disengaged from each other.
Figure 2:
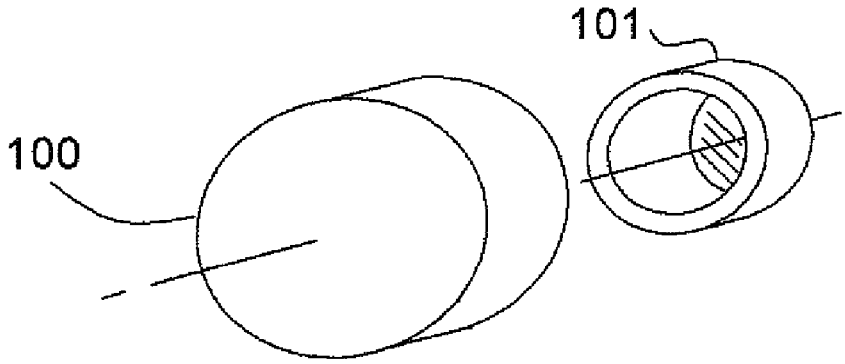
FIG. 2 is a second perspective view of the components of the invention disengaged from each other.

FIGS. 1 and 2 show two perspective views of the same 2-part electrical connector-cover according to a basic preferred embodiment of the invention. The first part of the electrical connector-cover may be nominated a plug-cover 100 and the second part may be nominated a socket-plug 101, the terms being descriptive of the functions of the first and second parts.

The first part of the connector-cover, plug-cover 100, is a hollow cylinder closed at one end and open at the other. The plug-cover has an internal diameter and an external diameter. The internal diameter of the plug-cover is frictionally equivalent to the outside diameter of the electrical plug that is protected by the plug-cover. The expression "frictionally equivalent" is used herein to mean that the external diameter of a first element is sufficiently equal to the internal diameter of a second, mating element to allow the second element to reversibly fit within the first element tightly enough to achieve the desired goal, such as making a watertight seal or holding the elements firmly together.

The second part of the connector-cover, socket-plug 101, is also a hollow cylinder closed at one end and open at the other. The socket-plug has in internal diameter and an external diameter. The external diameter of the socket-plug is frictionally equivalent to the internal diameter of the electrical socket that is protected by the socket-plug.

Figure 3:
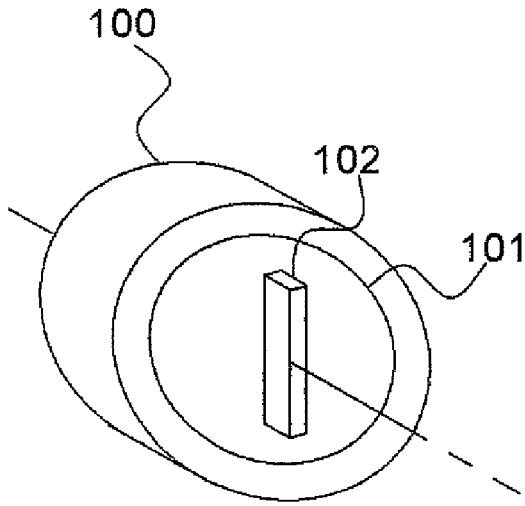
FIG. 3 is a perspective view of the components of the invention frictionally engaged for storage.

FIG. 3 shows the socket-plug 101 and plug-cover 100 frictionally engaged for storage. This is effected by providing the external diameter of the socket-plug frictionally equivalent to the internal diameter of the plug-cover. The unexpected advantage of the socket-plug and the plug-cover being frictionally engaged as shown in FIG. 3 is that the two can be stored together when not being used to protect the socket and plug. When the connectors are disconnected from each other and require protection, the socket-plug is separated from the plug-cover so that the protectors can be placed on the connectors, as described below.

FIGS. 1 and 3 show a grip-tab 102 on the socket-plug 101 The grip-tab is used to facilitate insertion and removal of the socket-plug within the plug-cover or within a socket.

Function and Usage

Figure 4:
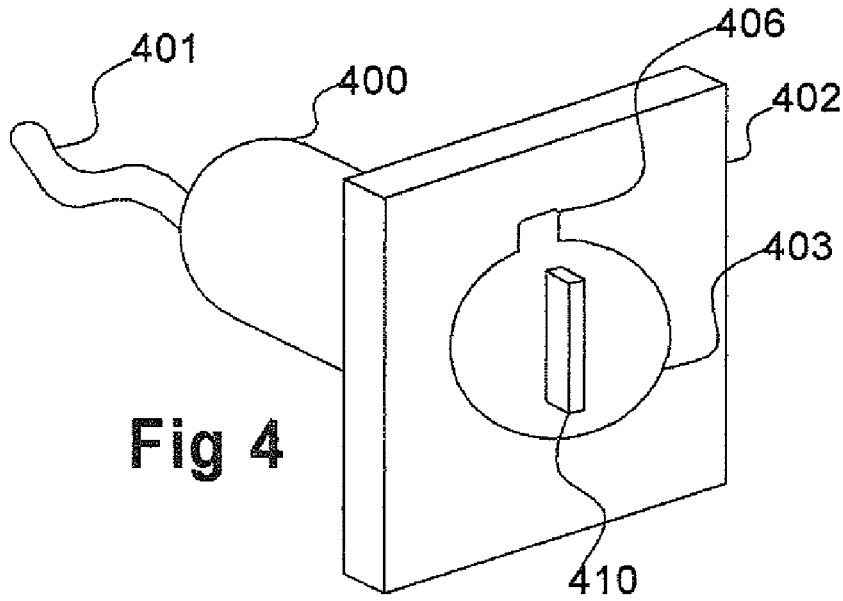
FIG. 4 is a perspective view of the socket-plug of the invention inserted into the electrical socket of a trailer hitch electrical connector.

FIG. 4 shows a socket-plug 403 according to the invention installed in a socket 400 of an electrical connector-set for a trailer hitch. As is typical, the socket is attached to plate 402 which is used to attach the socket to the vehicle, although in some situations, semi-tractors for instance, the socket may be found on the trailer. An electrical cable 401 carries the electrical wires that connect the source of electricity to male contacts within the socket. The outer diameter of socket-plug 403 is frictionally equivalent to the inner diameter of the socket. The hollow portion of the socket-plug accommodates the male terminals within the socket. The beneficial result of this frictional engagement between the socket-plug and the socket is to prevent water, moisture, dirt, dust and the like from gaining access to the socket.

Because the external diameter of the socket-plug is frictionally equivalent to the internal diameter of the socket, the socket-plug prevents water, moisture, dirt, dust and the like from gaining access to the electrical contacts of the socket.

Figure 5:
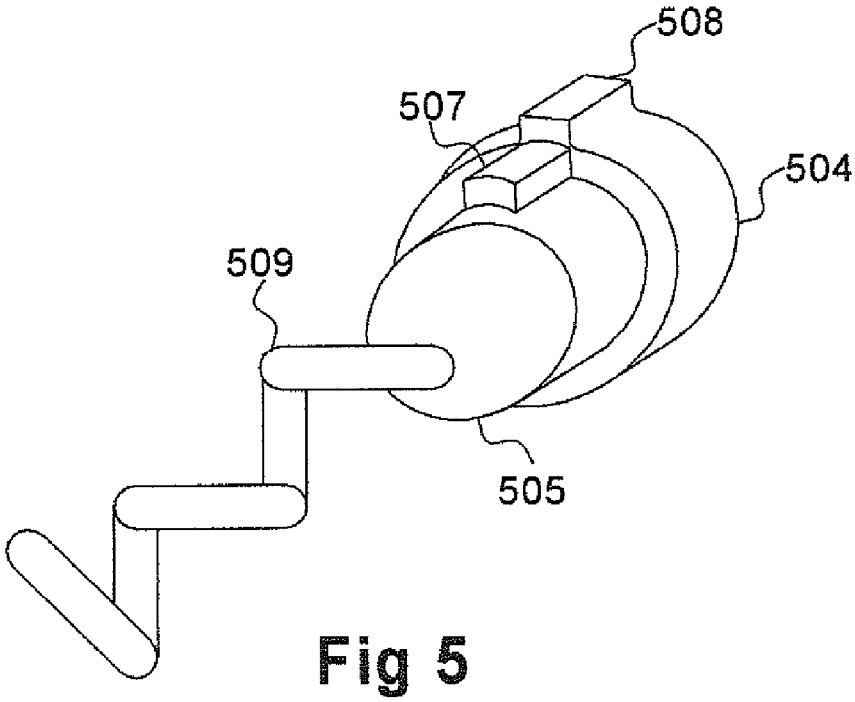
FIG. 5 is a perspective view of the plug-cover of the invention attached to the electrical plug of a trailer hitch electrical connector.

FIG. 5 shows an electrical plug 505 of the kind used in association with trailer hitches. The plug has an electrical cable 609 that carries electrical wires connecting the electrical components of the trailer to the female contacts (not shown) of the plug. A plug-cover 504 according to the invention is shown mounted on the plug 505. Because the internal diameter of the plug-cover is frictionally equivalent to the outer diameter of the plug, the plug-cover prevents water, dust, frost, dirt and the like from gaining access to the contacts when the plug is not in use.

When the socket-plug and the plug-cover are not being used to protect a socket and a plug, as for instance when the plug is connected to the socket, the socket-plug is inserted into the plug-cover as was shown in FIG. 3. Because the outer diameter of the socket-plug is frictionally equivalent to the inner diameter of the plug-cover, the two parts of the invention remain thus engaged until they are consciously separated from each other by the user in order to protect the plug and socket. Because they remain engaged while not in use, it is not necessary to first look for one and then look for the other one when the trailer becomes disconnected from the vehicle and the 2-part connector-cover is needed.

In order to use the invention to protect the socket and the plug, the socket-plug is first disengaged from the plug-cover by gripping the grip-tab of the socket-plug in one hand and the plug-cover in the other hand and pulling them apart. The socket-plug is thusly disengaged from the plug-cover and can be inserted into the socket, as shown in FIG. 4. Likewise, the plug-cover, now free from the socket-plug, can be attached to the plug as shown in FIG. 5.

Details, Refinements, and Variations

A grip-tab 410 of the socket-plug shown in FIG. 4. This element facilitates insertion and removal of socket-plug from the socket and from the plug-cover.

As is commonly found in the art of electrical connectors for trailer hitches, the plug shown in FIG. 5 has such an alignment key 507 that mates with a groove of the socket so that the male and female contacts will be properly aligned when the plug is inserted into the socket. Optionally, the plug-cover accommodates this key with either a protrusion 508, as shown, or with an indentation or partial groove in the plug-cover that the key 507 snugly fits into. Also, as shown in FIG. 4, an optional alignment key 406 protruding from the socket-plug mates with the alignment groove of the socket, thereby providing complete protection of the terminals within the socket.

Figure 6:
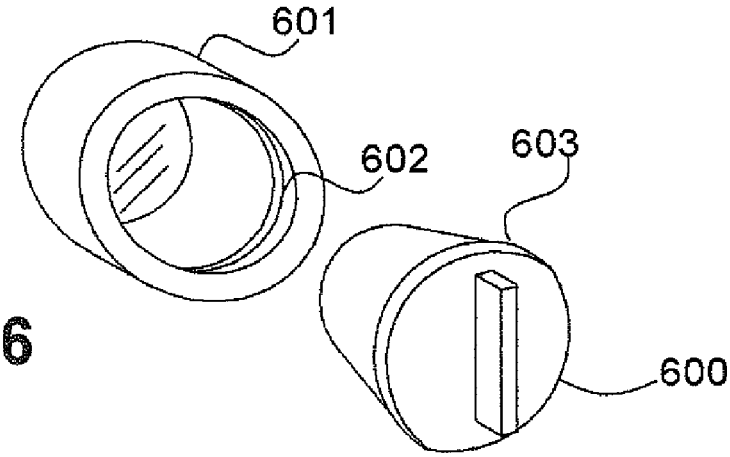
FIG. 6 is a third perspective view of the components of the invention disengaged from each other showing friction ridges.

From the foregoing disclosures, a number of design features, some with functional ramifications, will be apparent to one of skill in the art as being within the scope of the invention. For instance, the frictional purchase that the socket-plug and plug-cover achieve may be optionally produced by means of one or more friction elements that define the internal or external diameter of the plug-cover or socket-plug, respectively. Such friction elements are shown in FIG. 6 where the socket-plug 600 has a friction ridge 603 on the outer surface of the plug. Additionally or alternatively, plug-cover 601 can be provided with a friction ridge 602 on the interior surface. These ridges allow the two components to be more easily fitted to and removed from their respective electrical socket and plug because the frictional equivalency is restricted to just the ridge. For instance, as shown in FIG. 6, the socket-plug can be tapered so that only frictional ridge 603 on the exterior surface seals the socket. Within the context of the disclosures above and the claims that follow, these friction elements define the internal diameter and external diameter of the plug-cover and socket-plug.

The socket-plug and plug-cover of the invention can be made from a variety of materials that have sufficient elasticity to provide tight frictional engagement with the socket and plug, respectively. Rubber, for instance, can be used. A thermoplastic compound is preferred, and, more particularly, a thermoplastic elastomer such as Santoprene® is currently preferred.

SUMMARY

By means of summary, many of the features of the invention can be appreciated with reference to the following enumerated statements:

Statement 1. The invention includes a cover for an electrical connector of the type having an electrical plug that mates with an electrical socket, said cover comprising: a. a socket-plug, said socket-plug having an external diameter and an internal diameter, wherein said external diameter of said socket-plug is frictionally equivalent to an internal diameter of the electrical socket; and, b. a plug-cover, said plug-cover having an external diameter and an internal diameter, wherein said internal diameter of said plug-cover is frictionally equivalent to an external diameter of the electrical plug.

Statement 2. The invention includes a cover according to Statement 1 wherein said internal diameter of said plug-cover is frictionally equivalent to said external diameter of said socket-plug.

Statement 3. The invention includes a cover according to Statement 1 wherein said socket-plug comprises a grip-tab.

Statement 4. The invention includes a cover according to Statement 1 wherein said cover comprises a friction element on at least one of an outer surface of said socket-plug and an inner surface of said plug-cover.

Statement 5. The invention includes a cover according to Statement 4 wherein said friction element is a ridge.

Statement 6. The invention includes a cover according to Statement 1 further comprising: a. an alignment key on said socket-plug; and, b. an alignment protrusion or an indentation on said plug-cover, wherein said alignment protrusion or indentation accommodates said alignment key.

From the foregoing description, the novelty, utility, and means of using my invention will be readily apprehended. It is to be understood that the invention is not limited to the embodiments disclosed above but encompasses any and all embodiments lying within the scope of the disclosures made herein, including the figures and claims.

The invention claimed is:

1. A cover for an electrical connector of the type having an electrical plug that mates with an electrical socket, said cover comprising:

a. a socket-plug, said socket-plug having an external diameter and an internal diameter wherein said external diameter of said socket-plug is frictionally equivalent to an internal diameter of the electrical socket; and, b. a plug-cover, said plug-cover having an external diameter and an internal diameter, wherein said internal diameter of said plug-cover is frictionally equivalent to an external diameter of the electrical plug.

2. The cover of claim 1 wherein said internal diameter of said plug-cover is frictionally equivalent to said external diameter of said socket-plug.

3. The cover of claim 1 wherein said socket-plug comprises a grip-tab.

4. The cover of claim 1 wherein said cover comprises a friction element on at least one of an outer surface of said socket-plug and an inner surface of said plug-cover.

5. The cover of claim 4 wherein said friction element is a ridge.

6. The cover of claim 1 further comprising:

a. an alignment key on said socket-plug; and, b. an alignment protrusion or an indentation on said plug-cover, wherein said alignment protrusion or indentation accommodates said alignment key.

7. A device for protecting electrical connectors of the type having an electrical plug that mates with an electrical socket, said device comprising:

a. a hollow socket-plug for protecting the electrical socket, wherein said socket-plug comprises a grip tab, and wherein said hollow socket-plug has an external diameter and an internal diameter, and wherein said external diameter of said hollow socket-plug is frictionally equivalent to an internal diameter of the electrical socket; and, b. a hollow plug-cover for protecting the electrical plug, wherein said hollow plug-cover has an external diameter and an internal diameter, and wherein said internal diameter of said hollow plug-cover is frictionally equivalent to an external diameter of the electrical plug, and wherein said internal diameter of said hollow plug-cover is frictionally equivalent to said external diameter of said hollow socket-plug to allow said hollow socket-plug to be inserted into said hollow plug-cover;

wherein said grip-tab facilitates the insertion and removal of said hollow socket-plug from said hollow plug-cover and from the electrical socket.

8. The device of claim 7 further comprising a friction element on at least one of an outer surface of said hollow socket-plug and an inner surface of said hollow plug-cover.

9. The device of claim 8 wherein said friction element is a ridge.

10. The device of claim 9 wherein said hollow socket-plug is tapered.

11. The device of claim 7 further comprising:

a. an alignment key on said hollow socket-plug; and, b. an alignment protrusion or indentation on said hollow plug-cover wherein said alignment protrusion or indentation accommodates said alignment key.

12. The device of claim 7 wherein said hollow socket-plug and said hollow plug-cover are cylinders each having a closed end and an open end.

13. A device for protecting electrical connectors of the type having an electrical plug that mates with an electrical socket, said device comprising:

a. a hollow socket-plug for protecting the electrical socket, wherein said hollow socket-plug has an external diameter and an internal diameter, and wherein said external diameter of said hollow socket-plug is frictionally equivalent to an internal diameter of the electrical socket; and, b. a hollow plug-cover for protecting the electrical plug, wherein said hollow plug-cover has an external diameter and an internal diameter, and wherein said internal diameter of said hollow plug-cover is frictionally equivalent to an external diameter of the electrical plug, and wherein said internal diameter of said hollow plug-cover is frictionally equivalent to said external diameter of said socket-plug to allow said hollow socket-plug to be inserted into said hollow plug-cover;

wherein said hollow socket-plug and said hollow plug-cover are cylinders each having a closed end and an open end.

14. The device of claim 13 further comprising a friction element on at least one of an outer surface of said hollow socket-plug and an inner surface of said hollow plug-cover.

15. The device of claim 14 wherein said friction element is a ridge.

16. The device of claim 14 wherein said hollow socket-plug is tapered.

17. The device of claim 13 further comprising:

a. an alignment key on said hollow socket-plug; and, b. an alignment protrusion or indentation on said hollow plug-cover wherein said alignment protrusion or indentation accommodates said alignment key.

18. A device for protecting electrical connectors of the type having an electrical plug that mates with an electrical socket, said device comprising:

a. a hollow socket-plug for protecting the electrical socket, wherein said hollow socket-plug has an external diameter and an internal diameter, and wherein said external diameter of said hollow socket-plug is frictionally equivalent to an internal diameter of the electrical socket;

b. a hollow plug-cover for protecting the electrical plug, wherein said hollow plug-cover has an external diameter and an internal diameter, and wherein said internal diameter of said hollow plug-cover is frictionally equivalent to an external diameter of the electrical plug, and wherein said internal diameter of said hollow plug-cover is frictionally equivalent to said external diameter of said socket-plug;

c. an alignment key on said hollow socket-plug; and, d. an alignment protrusion or indentation on said hollow plug-cover wherein said alignment protrusion or indentation accommodates said alignment key.

19. The device of claim 18 further comprising a friction element on at least one of an outer surface of said hollow socket-plug or an inner surface of said hollow plug-cover, wherein said friction element is a ridge.

20. The device of claim 19 wherein hollow socket-plug is tapered.

21. The device of claim 18 wherein said hollow socket-plug and said hollow plug-cover are cylinders each having a closed end and an open end.

* * * * *